US008182230B2

(12) United States Patent
Stone

(10) Patent No.: US 8,182,230 B2
(45) Date of Patent: May 22, 2012

(54) FAN BLADE PRELOADING ARRANGEMENT AND METHOD

(75) Inventor: Paul Stone, Guelph (CA)

(73) Assignee: Pratt & Whitney Canada Corp., Longueuil (CA)

( * ) Notice: Subject to any disclaimer, the term of this patent is extended or adjusted under 35 U.S.C. 154(b) by 669 days.

(21) Appl. No.: 12/356,734

(22) Filed: Jan. 21, 2009

(65) Prior Publication Data

US 2010/0183444 A1 Jul. 22, 2010

(51) Int. Cl.
*F01D 1/00* (2006.01)
*F01D 1/04* (2006.01)

(52) U.S. Cl. ..... 416/220 R; 416/219 R

(58) Field of Classification Search ..... 416/220 R, 416/219 R

See application file for complete search history.

(56) References Cited

U.S. PATENT DOCUMENTS

| | | | | |
|---|---|---|---|---|
| 2,843,356 | A | 7/1958 | Hull, Jr. | |
| 2,846,183 | A | 8/1958 | Morgan | |
| 3,088,708 | A | 5/1963 | Feinberg | |
| 3,930,751 | A | 1/1976 | Straslicka et al. | |
| 3,955,898 | A | 5/1976 | Zaehring | |
| 4,050,850 | A * | 9/1977 | Beckershoff | 416/221 |
| 4,265,595 | A | 5/1981 | Bucy, Jr. et al. | |
| 4,400,137 | A | 8/1983 | Miller et al. | |
| 4,451,959 | A | 6/1984 | Miller et al. | |
| 4,483,661 | A | 11/1984 | Manharth et al. | |
| 4,676,723 | A | 6/1987 | Kiger et al. | |
| 4,767,275 | A | 8/1988 | Brown | |
| 4,820,127 | A * | 4/1989 | Cohen et al. | 416/221 |
| 4,859,149 | A | 8/1989 | McClain | |
| 5,131,814 | A * | 7/1992 | Przytulski et al. | 416/217 |
| 5,242,270 | A | 9/1993 | Partington et al. | |
| H1258 | H | 12/1993 | Hindle, Jr. | |
| 6,533,550 | B1 * | 3/2003 | Mills | 416/220 R |
| 6,752,598 | B2 | 6/2004 | Antunes et al. | |
| 6,981,847 | B2 * | 1/2006 | Arinci et al. | 416/193 A |
| 7,661,931 | B1 * | 2/2010 | Matheny | 416/220 R |
| 2004/0126239 | A1 * | 7/2004 | Gautreau et al. | 416/220 R |
| 2009/0053065 | A1 * | 2/2009 | Oka | 416/220 R |
| 2009/0208339 | A1 * | 8/2009 | Cherolis et al. | 416/219 R |
| 2009/0297908 | A1 * | 12/2009 | Kohl et al. | 429/31 |

* cited by examiner

*Primary Examiner* — Nitin Parekh
(74) *Attorney, Agent, or Firm* — Norton Rose Canada LLP

(57) ABSTRACT

The fan blade includes a blade root at one end thereof configured for sliding insertion into a substantially axially extending slot defined in a periphery of a fan rotor hub. The blade comprises a first passageway extending at least partially through the blade root, in a direction generally parallel to an axial direction of the slot. It also comprises a second passageway extending at least partially through the blade root to intersect with the first passageway. A first member is provided in the first passageway, the first member configured to be retained in the first passageway once inserted therein, and a second member is provided in the second passageway, the second member having one end in cooperating engagement with the end of the first member. The second member has a portion projecting out of the bottom face of the blade root a distance sufficient to contact an inner surface of the slot and thereby force the blade outwardly in the slot.

17 Claims, 2 Drawing Sheets

FAN BLADE PRELOADING ARRANGEMENT AND METHOD

TECHNICAL FIELD

The technical field generally relates to fan blades for use in turbofan gas turbine engines.

BACKGROUND

At low rotation speeds, which can occur for instance when the gas turbine engine is started or shut-down, or during windmilling, the movement of the blade roots within the blade retention slots can cause wear. The clearance between a blade root and its blade retention slot can cause the blade root to flop around in the blade retention slot. After many hours of this action, the mating surfaces on the blade root and the blade retention slot can wear away. This wear can have a detrimental impact on the low cycle fatigue life of the fan rotor hub and of the blades.

It is known to provide devices to bias the blades outwardly so as to reduce blade wear occuring at low rotation speeds, but known devices are often relatively complex to assemble. Room for improvements thus exists.

SUMMARY

In one aspect, the present concept provides a fan blade for a turbofan gas turbine engine, the blade including a blade root at one end thereof configured for sliding insertion into a substantially axially extending slot defined in a periphery of a fan rotor hub, the slot extending from a front side of the hub to a back side, the blade root having side faces respectively corresponding to the front and back sides of the hub, the blade root also having a bottom face which opposes the slot when the blade is inserted in the slot, the blade comprising: a first passageway extending at least partially through the blade root from one of said side faces of the blade root in a direction generally parallel to an axial direction of the slot, the first passageway having an entrance in the side face disposed to be accessible to a service person when the blade is inserted in the slot; a second passageway extending at least partially through the blade root from the bottom face of the blade root to intersect with the first passageway; a first member provided in the first passageway, the first member configured to be retained in the first passageway once inserted therein; and a second member provided in the second passageway, the second member having one end in cooperating engagement with the first member such that movement of the first member in a direction of the first passageway causes the second member to move in a direction of the second passageway and extend outwardly, the second member thus having a portion projecting out of the bottom face of the blade root a distance sufficient to contact an inner surface of the slot and thereby force the blade outwardly in the slot.

In another aspect, the present concept provides a fan blade for a gas turbine engine, the blade having a blade root configured to be slidingly inserted into a blade retention slot provided at a periphery of a fan rotor hub, the blade comprising: a first pin having a first end and a second end, the second end of the first pin having a surface obliquely angled relatively to sides of the first pin; a second pin having a first end and a second end, the first end of the second pin having a surface obliquely angled relatively to sides of the second pin and engaging the obliquely angled surface of the second end of the first pin; and a third pin having a first end and a second end, the third pin having its first end engaging the second end of the second pin; a first passageway provided substantially parallel to a longitudinal axis of the blade retention slot, the first pin inserted in the first passageway; a second passageway orthogonally intersecting the first passageway, the second pin and the third pin inserted in the second passageway; whereby, when a longitudinal force is provided at the first end of the first pin, a longitudinal reaction force is created in the second pin, which causes the second end of the third pin to extend from the blade root and engage the blade retention slot to push the blade root away from a bottom of the slot.

In a further aspect, the present concept provides a method of outwardly seating a fan blade root initially loosely fitted within a blade retention slot on a fan rotor hub, the method comprising: providing a pair of intersecting passageways located within the blade root, one of the passageways extending in a substantially axial direction of the blade root and having an opening on a side face of the blade root, the other passageway extending in a substantially radial direction and having an opening on a bottom side of the blade root; and pushing a first member extending in the axial passageway and transferring a motion of the first member to a second member extending in the radial passageway, the motion causing a portion of the second member to extend out of the opening on the bottom side and abut against a surface of the blade retention slot, the first member being pushed until the blade root is outwardly seated within the blade retention slot.

Further details of these and other aspects will be apparent from the detailed description and figures included below.

DETAILED DESCRIPTION

Figure 1:
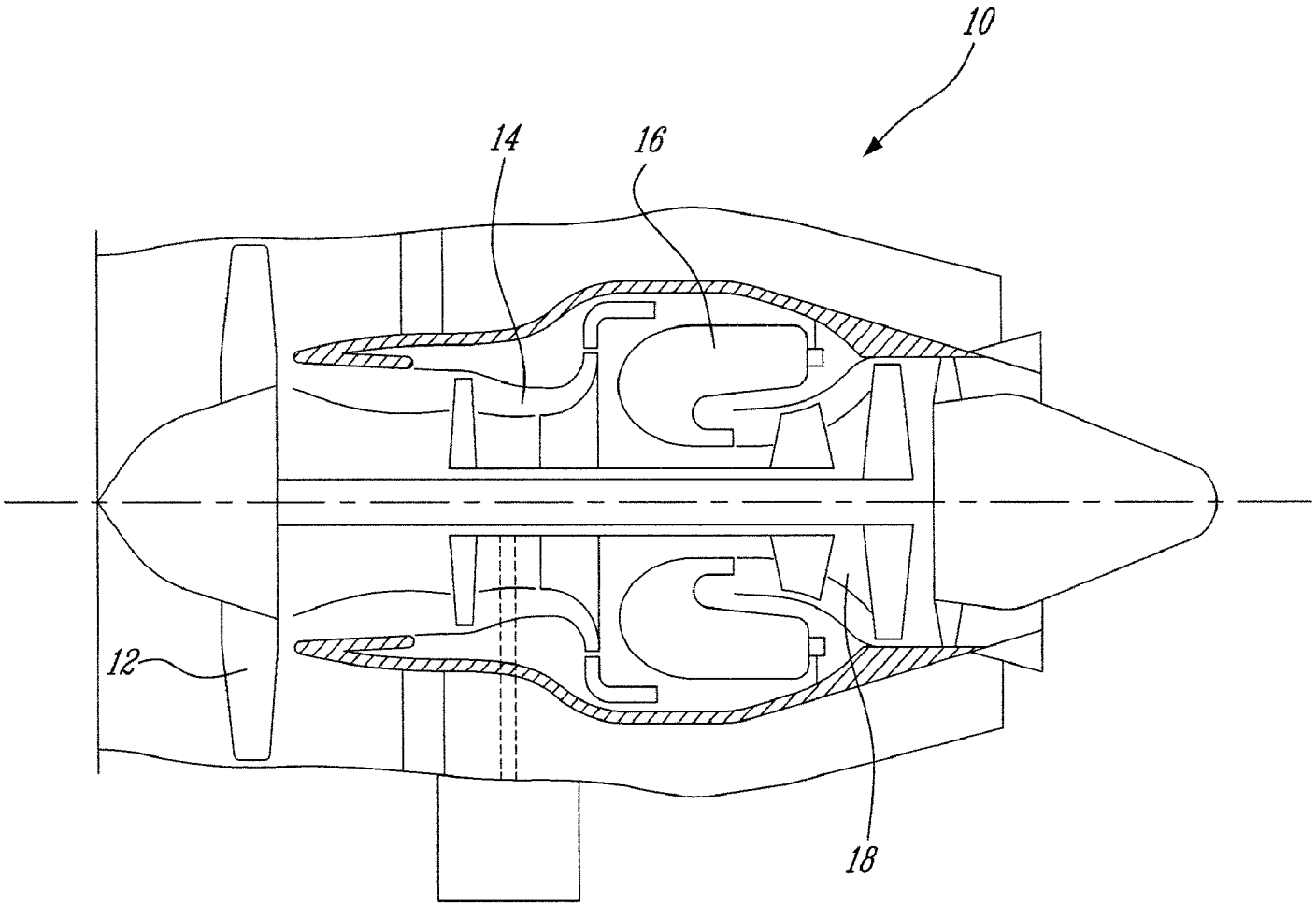
FIG. 1 schematically shows an example of a turbofan gas turbine engine to illustrate one example of a general environment in which the improved fan blade and method can be used.

FIG. 1 illustrates an example of a turbofan gas turbine engine 10 of a type provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases. FIG. 1 shows one example of an environment in which a fan blade with the preloading arrangement and a method as described hereafter can be used.

Figure 2:
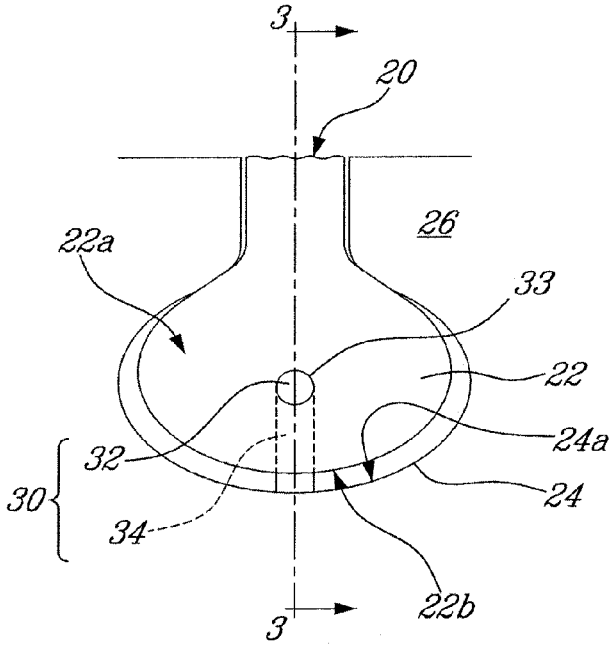
FIG. 2 is a schematic plan view showing an example of a fan blade retained in a blade retention slot and including an example of a fan blade preloading arrangement.

FIG. 2 is a schematic plan view showing an example of one fan blade 20 having a blade root 22 removably inserted in a fan blade retention slot 24 of a fan rotor hub 26. The hub 26 comprises a plurality of these fan blades disposed circumferentially on the periphery thereof. The blade 20 can be used, for instance, in the fan 12 of the turbofan gas turbine engine 10 shown in FIG. 1.

The blade root 22 of the blade 20 has a lengthwise direction (the direction going perpendicularly into the sheet in FIG. 2) and a widthwise direction (the horizontal direction in FIG. 2). The lengthwise direction of the blade root 22 is thus a direction that is substantially parallel to the longitudinal axis of the blade retention slot 24. This direction extends substantially axially with reference to the rotation axis of the hub 26. Although some hubs have blade retention slots with a longitudinal axis that is somewhat slightly oblique with reference to the rotation axis, they are nevertheless considered to be substantially axially extending.

The blade 20 is provided with a blade preloading arrangement 30. In the illustrated example, the arrangement 30 comprises a first substantially linear passageway 32 extending lengthwise inside the blade root 22 from an opening 33 at a side face 22*a* of the blade root 22. The first passageway 32 has an entrance in the side face disposed to be accessible to a service person when the blade 20 is inserted in the blade retention slot 24.

Figure 3:
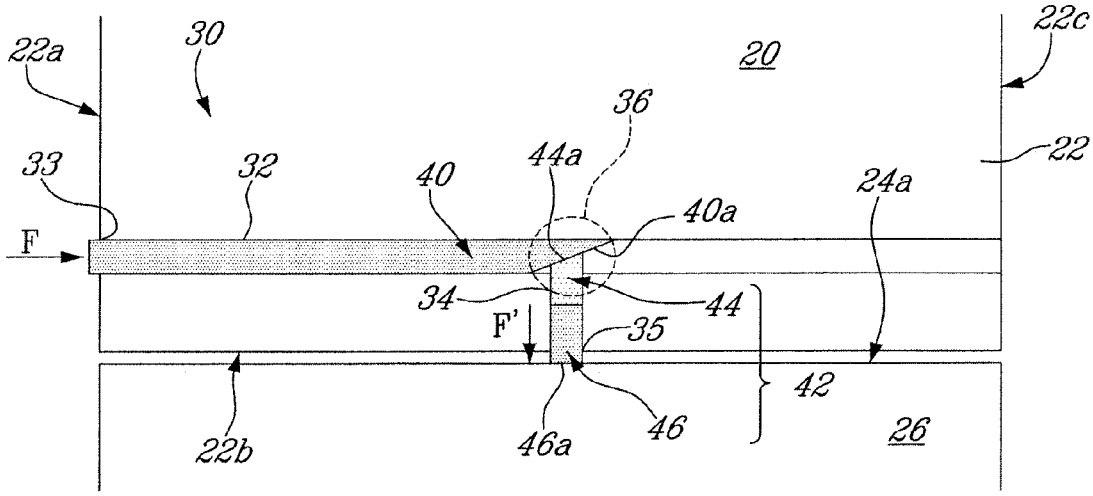
FIG. 3 is a schematic cross section of the fan blade and of the blade retention slot taken along line 3-3 in FIG. 2.

As shown in FIG. 3, which is a schematic cross section of the blade 20 and of the blade retention slot 24 taken along line 3-3 in FIG. 2, the arrangement 30 also comprises a second substantially linear passageway 34 extending substantially radially from an opening 35 at a bottom face 22*b* of the blade root 22 and an intersection 36 with the first passageway 32. Both passageways 32, 34 of the illustrated example have a circular cross section and a diameter that is substantially equal. Both passageways 32, 34 are also orthogonal at the intersection 36. Variants, however, are possible.

The arrangement 30 further comprises a first member 40 extending in the first passageway 32. The first member 40 has one end located adjacent to the intersection 36. A second member 42 is provided in the second passageway 34. The second member 42 has one end in cooperating engagement with the corresponding end of the first member 40. The second member 42 has a portion projecting out of the bottom face 22*b* of the blade root 22.

It should be noted that FIG. 3 shows the first passageway 32 spanning from one side face 22*a* of the blade root 22 to a second side face 22*c* thereof. The first passageway 32 can also be shorter than the length of the blade root 22.

The first member 40 of the illustrated example consists of an elongated pin, hereafter referred to as the first pin 40, having opposite first and second ends. The second end of the first pin 40 has a surface 40*a* obliquely angled relatively to sides of the first pin 40. In this case, the surface 40*a* is a bevelled surface. Other configurations are possible.

The second member 42 of the illustrated example consists of a set of two juxtaposed pins, hereafter referred to as the second pin 44 and the third pin 46. The second pin 44 has opposite first and second ends. Likewise, the third pin 46 has opposite first and second ends. The first end of the second pin 44 has an obliquely angled surface 44*a*, in this case a bevelled surface. Other configurations are possible.

The third pin 46 has its first end engaging the second end of the second pin 44, both abutting ends being flat in the illustrated example. The second end 46*a* of the third pin 46 extends out below the bottom face 22*b* of the blade root 22.

Once the various pins 40, 44, 46 are in position, the bevelled surface 40*a* of the second end of the first pin 40 engages the bevelled surface 44*a* of the first end of the second pin 44. With the pair of mating bevelled surfaces 40*a*, 44*a* having complementary angles, the first pin 40 and the second pin 44 are configured and disposed so that when a longitudinal force is provided at the first end of the first pin 40, such as the force F depicted in FIG. 3, the force F can generate a longitudinal reaction force F' through the second 44 and third pins 46. The force F' is also depicted in FIG. 3. The second end 46*a* of the third pin 46 then extends further out below the blade root 22 to push the blade root 22 outwardly in the blade retention slot 24. Thus, the second end 46*a* of the third pin 46, upon engaging the bottom surface 24*a* of the blade retention slot 24, can move the whole blade 20 outwards.

As can be appreciated, the arrangement can outwardly seat the fan blade root 22 within the blade retention slot 24. With this arrangement, pushing on the first pin 40 transfers a motion of the first pin 40 to the second 44 and third pins 46, thereby causing a portion (adjacent the end 46*a*) of the third pin 46 to extend or further extend out of the bottom opening 35 and abut against the bottom surface 24*a* of the blade retention slot 24. The first pin 40 can be further pushed until the blade root 22 is completed seated within the outer side of blade retention slot 24.

The third pin 46 can be made of a resilient material such as nylon or rubber, thereby forming a plug that acts as a spring. A compression of the nylon or rubber plug 46 can maintain a constant outward bias on the blade root 22. The resilient plug 46 can be made softer than the other pins 40, 44. It can thus prevent damages, for instance surface scratches, to the bottom surface 24*a* of the blade retention slot 24.

If desired, the first pin 40 can be pushed axially by an insert (not shown) threaded at the side opening 33 or by a retaining ring (not shown) that is attached to the front of the fan of a turbofan gas turbine engine. This arrangement can maintain the force F for as long as the preloading is required. The first pin 40 would be shorter than what is illustrated herein. The first pin 40 can also be otherwise retained in the first passageway 32, for instance using an interfering engagement or adhesives.

The above description is meant to be exemplary only, and one skilled in the art will recognize that changes may be made to the embodiments described without departing from what is disclosed herein. For example, the exact shape or location of the passageways can be different from what is shown. More than one set of passageways can be provided in a same blade root. The shape of the blade and the hub can be different from that shown in the figures. The passageways do not necessarily need to have identical diameters, as shown. The third pin can be merged with the second pin. For instance, the bias can be provided by the first and/or the second pin, or by a portion of these pins that is more resilient than the others. The pins do not have to be aligned precisely axially or radially, as long as the basic geometry results in a radially downward force to bias the blade root radially outwardly. Still other modifications will be apparent to those skilled in the art, in light of a review of this disclosure, and such modifications are intended to fall within the appended claims.

What is claimed is:

1. A fan blade for a turbofan gas turbine engine, the blade including a blade root at one end thereof configured for sliding insertion into a substantially axially extending slot defined in a periphery of a fan rotor hub, the slot extending from a front side of the hub to a back side, the blade root having side faces respectively corresponding to the front and back sides of the hub, the blade root also having a bottom face which opposes the slot when the blade is inserted in the slot, the blade comprising:

a first passageway extending at least partially through the blade root from one of said side faces of the blade root in a direction generally parallel to an axial direction of the slot, the first passageway having an entrance in one of said side faces disposed to be accessible to a service person when the blade is inserted in the slot;

a second passageway extending at least partially through the blade root from the bottom face of the blade root to intersect with the first passageway;

a first member provided in the first passageway, the first member configured to be retained in the first passageway once inserted therein; and a second member provided in the second passageway, the second member having one end in cooperating engagement with the first member such that movement of the first member in a direction of the first passageway causes the second member to move in a direction of the second passageway and extend outwardly, the second member thus having a portion projecting out of the bottom face of the blade root a distance sufficient to contact an inner surface of the slot and thereby force the blade outwardly in the slot.

2. The blade as defined in claim 1, wherein the first member has one end in cooperating engagement with an end of the second member.

3. The blade as defined in claim 2, wherein the first passageway and the second passageway have a circular cross section.

4. The blade as defined in claim 3, wherein the first passageway and the second passageway have a substantially equal diameter.

5. The blade as defined in claim 2, wherein the cooperating engagement between the first member and the second member is provided by a pair of mating bevelled surfaces, one of the surfaces at the end of the first member and the other of the surfaces at the end of the second member.

6. The blade as defined in claim 1, wherein the first passageway and the second passageway are orthogonal at their intersection.

7. The blade as defined in claim 1, wherein the first passageway spans substantially across the entire length of the blade root.

8. The blade as defined in claim 7, wherein the cooperating engagement is made substantially at a center of the length of the first passageway.

9. The blade as defined in claim 1, wherein the second member includes a first portion and a second portion, both being juxtaposed in the second passageway and made of a different material.

10. The blade as defined in claim 9, wherein the second portion is more resilient than the first portion and contacts the inner surface of the slot.

11. The blade as defined in claim 10, wherein the second portion is made of nylon.

12. The blade as defined in claim 10, wherein the second portion is made of rubber.

13. The blade as defined in claim 1, wherein the first passageway and the second passageway are substantially linear.

14. The blade as defined in claim 1, wherein the first passageway is provided substantially at a center of the blade root in the widthwise direction.

15. A fan blade for a gas turbine engine, the blade having a blade root configured to be slidingly inserted into a blade retention slot provided at a periphery of a fan rotor hub, the blade comprising:

a first pin having a first end and a second end, the second end of the first pin having a surface obliquely angled relatively to sides of the first pin;

a second pin having a first end and a second end, the first end of the second pin having a surface obliquely angled relatively to sides of the second pin and engaging the obliquely angled surface of the second end of the first pin; and a third pin having a first end and a second end, the third pin having its first end engaging the second end of the second pin;

a first passageway provided substantially parallel to a longitudinal axis of the blade retention slot, the first pin inserted in the first passageway;

a second passageway orthogonally intersecting the first passageway, the second pin and the third pin inserted in the second passageway;

whereby, when a longitudinal force is provided at the first end of the first pin, a longitudinal reaction force is created in the second pin, which causes the second end of the third pin to extend from the blade root and engage the blade retention slot to push the blade root away from a bottom of the slot.

16. The blade as defined in claim 15, wherein the obliquely angled surfaces are bevelled surfaces with complementary angles.

17. A method of outwardly seating a fan blade root initially loosely fitted within a blade retention slot on a fan rotor hub, the method comprising:

providing a pair of intersecting passageways located within the blade root, one of the passageways extending in a substantially axial direction of the blade root and having an opening on a side face of the blade root, the other passageway extending in a substantially radial direction and having an opening on a bottom side of the blade root; and pushing a first member extending in the axial passageway and transferring a motion of the first member to a second member extending in the radial passageway, the motion causing a portion of the second member to extend out of the opening on the bottom side and abut against a surface of the blade retention slot, the first member :being pushed until the blade root is outwardly seated within the blade retention slot.

* * * * *